US005852885A

United States Patent [19]

Ferniani

[11] Patent Number: 5,852,885

[45] Date of Patent: Dec. 29, 1998

[54] SANDAL TYPE FOOTWEAR

[75] Inventor: Aldo Ferniani, Padova, Italy

[73] Assignee: Exo Italia S.r.l., Padova, Italy

[21] Appl. No.: 708,108

[22] Filed: Sep. 6, 1996

Related U.S. Application Data

[63] Continuation of Ser. No. 341,124, Nov. 18, 1994, abandoned.

[30] Foreign Application Priority Data

Nov. 22, 1993 [IT] Italy ..... PD930134 U

[51] Int. Cl.[6] ..... A43B 3/12; A43B 3/24

[52] U.S. Cl. ..... 36/11.5; 36/101

[58] Field of Search ..... 36/11.5, 100, 101, 36/97, 112, 114, 45

[56] References Cited

U.S. PATENT DOCUMENTS

| | | | |
|---|---|---|---|
| 3,154,866 | 11/1964 | Laufbahn | 36/101 |
| 3,902,259 | 9/1975 | Cracco | 36/11.5 |
| 3,978,596 | 9/1976 | Brown et al. | 36/11.5 |
| 4,172,330 | 10/1979 | Kao | 36/11.5 |
| 4,193,214 | 3/1980 | Wang | 36/11.5 |
| 4,461,102 | 7/1984 | De Vincentis | 36/11.5 X |
| 4,535,554 | 8/1985 | De Obaldia | 36/11.5 X |
| 4,753,022 | 6/1988 | Gasbarro | 36/11.5 X |

FOREIGN PATENT DOCUMENTS

| | | | |
|---|---|---|---|
| 2246163 | 5/1975 | France | 36/101 |

*Primary Examiner*—B. Dayoan
*Attorney, Agent, or Firm*—Guido Modiano; Albert Josif

[57] ABSTRACT

The present invention relates to footwear having simplified assembly, which comprises a sole, which is made of plastics and has edges that are at least locally raised, and an upper, which is also made of plastics and has tabs with an enlarged head that are suitable to enter holes provided in the edges of the upper and to anchor themselves so that they withstand transversely the traction applied by the upper.

7 Claims, 1 Drawing Sheet

SANDAL TYPE FOOTWEAR

This is a continuation application of application Ser. No. 08/341,124 filed on Nov. 18, 1994, now abandoned.

BACKGROUND OF THE INVENTION

The present invention relates to footwear having a simplified method of assembly.

The assembly operation is crucial as regards costs in the manufacture of low-cost non-monolithic footwear. Footwear has accordingly been designed in which the various parts that compose the item are provided with mutual engagement means that therefore do not require additional materials or operations such as glueing or stitching for final assembly.

An example of footwear produced in this manner is constituted by sandals of the so-called "thong" type.

In these sandals, the sole is produced by injection-molding a relatively soft plastics, whereas the upper has "buttons" that pass through holes provided on the insole part and have a wider cross-section in their lower part, where the head of the button is seated.

This method indeed simplifies assembly, which however is rather unstable.

In order to enter the hole, the head of the button or the sole must in fact be easily deformable, so that the same force that has allowed the insertion of the button also allows its removal.

In addition to this, there is a further problem linked to the fact that the sole in any case has holes and allows for example liquids to flow from the walking surface to the foot.

Another problem is related to the fact that the holes for accommodating the buttons cannot be too close to the perimetric edge of the sole, since this might make said sole easily breakable.

It is also inconceivable, both aesthetically and from the point of view of economy in production, to have a large flange outside the footprint of the upper in order to firmly accommodate the buttons of the upper.

SUMMARY OF THE INVENTION

The aim of the present invention is to provide footwear that allows easy assembly but at the same time eliminates the problems observed in footwear meant for the same purposes.

A consequent primary object is to achieve an assembly that is very strong even when considerable stresses are applied to the upper.

Another object is to provide footwear that eliminates the hygiene and comfort problems caused by the presence or through holes in the sole.

This aim, these objects, and others which will become apparent hereinafter are achieved by footwear having simplified assembly, characterized in that it comprises a sole, which is made of plastics and has edges that are at least locally raised, and an upper, which is also made of plastics and has tabs with an enlarged head that are suitable to enter holes provided in said edges and to anchor themselves so that they withstand transversely the traction applied by said upper.

BRIEF DESCRIPTION OF THE DRAWINGS

Further characteristics and advantages of the invention will become apparent from the detailed description of a preferred embodiment, illustrated only by way of non-limitative example in the accompanying drawings, wherein.

DESCRIPTION OF THE PREFERRED EMBODIMENTS

Figure 1:
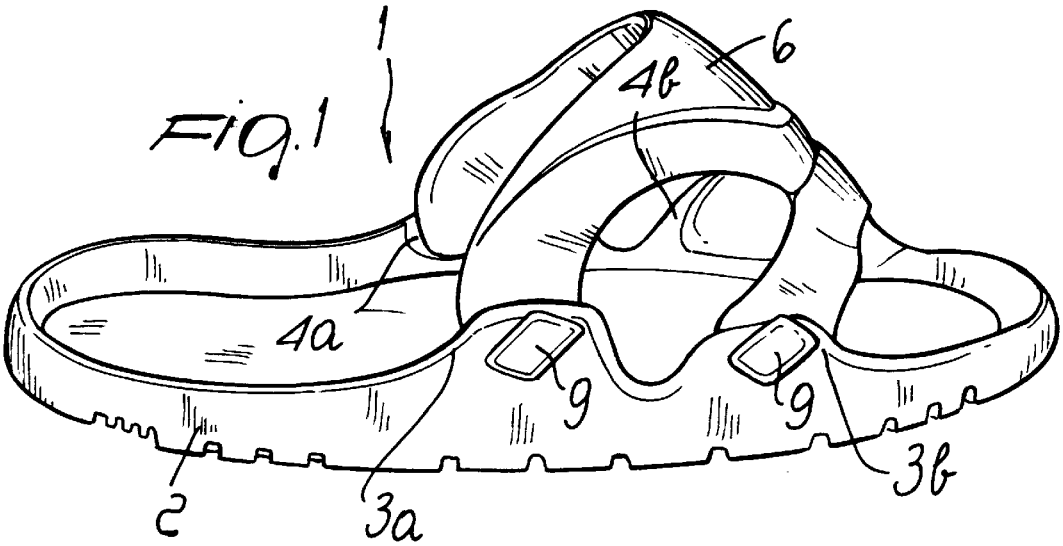
FIG. 1 is a general view of an item of footwear according to the invention.
Figure 2:
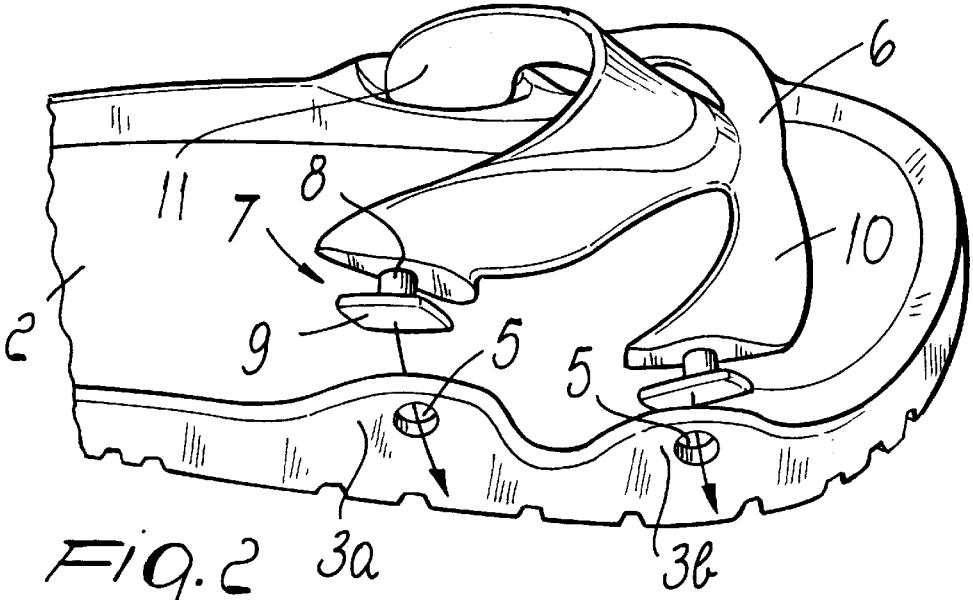
FIG. 2 is a partially sectional view of the operation for assembling the upper to the sole.
Figure 3:
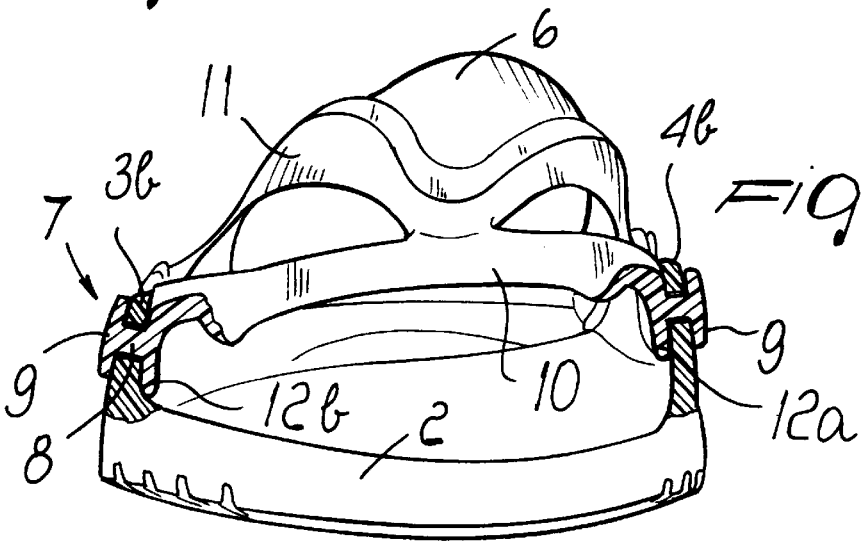
FIG. 3 is a sectional view of the item of footwear according to the invention, taken at the coupling tabs.

With reference to the above figures, the item of footwear, generally designated by the reference numeral 1, is composed of a sole 2 which is made of plastics and preferably EVA (ethyl vinyl acetate), polyurethane, or PVC (polyvinyl chloride).

Said sole is obtained by injecting plastics in a mold and has, in the illustrated case, a perimetric edge, two raised portions of said edge being provided on each side of the sole, designated by the reference numerals 3*a*, 3*b* and 4*a*, 4*b* respectively.

With reference now only to the edges 3*a* and 3*b*, which are obtained during the same molding operation that forms the sole so that they are monolithic with it, said raised portions of the edge have two through holes, designated by the reference numeral 5, which are preferably obtained by punching after the sole has been formed.

An upper, designated by the reference numeral 6, is mounted on said sole; in the illustrated case, said upper is of the open or sandal-like type which has four tabs, designated by the reference numeral 7, constituted by a cylindrical stem 8 which is completed by an enlarged head 9.

As seen in the drawings, the upper 6 has a front strap portion extending at a metatarsal region of the item of footwear 1 substantially horizontally between two oppositely arranged front raised portions 5. The upper 6 further has a pair of lateral vertical wall portions 12*a* and 12*b* each of which is connected at a respective end of the front strap portion 10. Each of the pair of lateral vertical wall portions 12*a* and 12*b* extend substantially perpendicularly to the horizontal extension of the front strap portion 10, and each of the pair of lateral vertical wall portions 12*a* and 12*b* is arranged in contact with a respective front raised portion 5. The stems 8 of the tabs 7 are connected to the lateral vertical wall portions 12*a* and 12*b* so as to extend substantially perpendicularly thereto.

The upper 6 further includes a middle strap portion 11 extending at a foot instep region of the item of footwear 1 in a curved configuration between two oppositely arranged middle raised portions 5. The tabs 7 are also connected at ends of the middle strap portion 11 for connecting it between the two oppositely arranged middle raised portions 5. The middle strap portion 11 is connected to the front strap portion 10 in a median region of the two portions. The upper 6 also only at the front strap portion 10 and middle strap portion 11 so that only the forward portion of the foot of a user of the item of footwear 1 is affected by the upper 6, while the rear achilles tendon region and malleolar regions of the user's ankle are not affected by the upper 6, nor by any other portion of the item of footwear 1.

The heads, the stem, and the upper are formed monolithically with a single molding operation.

In this case, too, the same materials used to form the sole are preferably used.

In order to assemble the two parts, the heads 9, which are flexible because they are made of soft plastics, are inserted in the holes 5 until they fully protrude from them, so that only the stems 8 affect the holes 5.

The drawing and the description clearly show that traction loads applied to the upper are transferred to the stems 8, which are subjected to shearing and not to traction.

This is very important, since the resistance of the heads 9 to removal is much greater than it would be if the stems 8 were subjected to axial traction.

From what has been described and illustrated it is evident that the assembly of the two parts of the item of footwear is extremely simple but, at the same time, that there are no collateral problems linked to the strength of the connection or problems linked to the hygiene of the item of footwear or to its degree of comfort.

The innovative concept can be extended to footwear in which the upper 6, instead of being of the open or sandal type, is complete and affects the entire sole.

In this case, the tabs with enlarged head such as 7 can be far more numerous, since they are distributed along the entire perimeter of the sole.

In any case, it is once again stressed that the sole is obtained an a monolithic injection-molded part, whereas the upper can be made of one or more parts; assembly is in any case the result of a purely mechanical coupling, without the need for stitches, welds, or glueing operations that would require complicated machines, specialized labor, and industrial components such as adhesives.

It is obvious that starting from the same innovative concept the shapes of the sole and of the upper or of the footwear may be any according to the choices and taste of the designer.

The materials, as mentioned, belong to the group of injectable plastics that are most suited for this type of solution.

What is claimed is:

1. Footwear having simplified assembly, comprising:

a sole having a perimetric edge;

raised portions of said edge on each side of the sole extending upwardly from the sole;

through holes provided on said raised portions;

an upper mounted on said sole, said upper having a front strap portion extending at a metatarsal region of the footwear substantially horizontally between two oppositely arranged front raised portions of said raised portions, said upper further having a pair of lateral vertical wall portions each of which is connected at a respective end of said front strap portion, each of said pair of lateral vertical wall portions extending substantially perpendicularly to the extension of said front strap portion at said respective end, and each of said pair of lateral vertical wall portions being arranged in contact with a respective front raised portion of said two oppositely arranged front raised portions;

tabs provided on said pair of lateral vertical wall portions, each tab having a stem with a first end and second end, said first ends being connected to said pair of lateral vertical wall portions such that said stems extend substantially perpendicularly to said pair of lateral vertical wall portions;

enlarged heads of said tabs connected to said second ends of said stems, said heads being inserted through said holes such that the stems of said tabs are engaged in said holes for connecting said front strap portion between said two oppositely arranged front raised portions.

2. Footwear according to claim 1, wherein said upper further comprises a middle strap portion extending at a foot instep region of the footwear in a curved configuration between two oppositely arranged middle raised portions of said raised portions, and wherein the footwear further comprises tabs being connected at ends of said middle strap portion and each having a stem extending through a respective hole in said middle raised portions and an enlarged head inserted through said respective hold for connecting said middle strap portion between said two oppositely arranged middle raised portions.

3. Footwear according to claim 2, wherein said middle strap portion is connected to said front strap portion in a median region.

4. Footwear according to claim 1, wherein the upper, the stems, and the heads are formed monolithically.

5. Footwear according to claim 1, wherein the sole is a monolithic injection-molded part.

6. Footwear according to claim 1, wherein said sole and said upper are made of a material selected from the group consisting of ethyl vinyl acetate, polyvinyl chloride and polyurethane.

7. Footwear according to claim 1 wherein said upper extends such that only a forward portion of a foot of a user of the footwear is affected by said upper and a rear achilles tendon region and malleolar regions of an ankle of the user of the footwear are unaffected by said footwear.

* * * * *